United States Patent [19]

Scarselletta

[11] Patent Number: 4,719,967

[45] Date of Patent: Jan. 19, 1988

[54] HEAT EXCHANGER CORE WITH SHEARABLE REINFORCEMENTS

[75] Inventor: Louis Scarselletta, Lockport, N.Y.

[73] Assignee: General Motors Corporation, Detroit, Mich.

[21] Appl. No.: 65,010

[22] Filed: Jun. 22, 1987

[51] Int. Cl.[4] ..... B21D 53/02; B23P 15/26

[52] U.S. Cl. ..... 165/76; 165/149; 29/157.3 R; 228/160; 228/183

[58] Field of Search ..... 165/76, 149; 29/157.3 R; 228/160, 183

[56] References Cited

U.S. PATENT DOCUMENTS

| | | | |
|---|---|---|---|
| 3,894,580 | 7/1975 | Chartet | 165/149 X |
| 3,939,908 | 2/1976 | Chartet | 165/149 |
| 4,398,332 | 8/1983 | Rhodes | 165/148 X |
| 4,619,313 | 10/1986 | Rhodes et al. | 165/149 X |

*Primary Examiner*—Albert W. Davis, Jr.
*Assistant Examiner*—Richard R. Cole
*Attorney, Agent, or Firm*—R. L. Phillips

[57] ABSTRACT

The reinforcements in a radiator core assembly are perforated so as to form a shear zone in the legs thereof that maintain rigidity in the reinforcements for stacking and brazing and can be readily sheared thereafter.

4 Claims, 7 Drawing Figures

HEAT EXCHANGER CORE WITH SHEARABLE REINFORCEMENTS

TECHNICAL FIELD

This invention relates to heat exchanger cores and more particularly to relieving the thermally induced tube/header stress.

BACKGROUND OF THE INVENTION

In heat exchanger cores such as motor vehicle radiator cores, such cores endure many thermal cycles in their service life time as engine coolant temperatures swing between ambient and operating temperatures. Tube metal temperatures follow the coolant temperatures and as a result, the tubes connected to the headers grow/contract axially to a substantial degree. On the other hand, the channel-shaped core reinforcements which are also normally connected to the headers are far less affected by the coolant temperatures and therefore grow at a different rate. As a result, the core reinforcements induce stress in the tube-to-header joints during the coolant thermal cycles that can be significant. Heretofore, such thermally induced tube-to-header joint stress has been relieved where need be by saw cutting the reinforcements following brazing and before the radiator is placed in service. However, the saw cutting operation is a difficult process to automate because of the difficulties associated with handling cutting lubricants and metal chips. Moreover, saw blade maintenance, air center destruction immediately adjacent to the saw cut and the potential for damaging the tube nearest the reinforcement makes the saw cutting operation undesirable.

SUMMARY OF THE PRESENT INVENTION

The present invention is directed to providing what will be referred to as a shear compatible reinforcement which eliminates saw cutting, lubricants and the attendant metal chips. An object of the present invention is to provide or maintain core reinforcement rigidity during the braze while offering simplified means to "fracture" the reinforcement after the braze. Another object is to retain the load on the air centers during the stack and braze operations and to avoid the extra labor associated with two-piece reinforcements.

This is simply accomplished by piercing or slotting the reinforcements both transversely and longitudinally so as to leave a zone on the legs of these that maintains beam rigidity in the reinforcement for stacking and brazing and may be simply sheared after brazing to fully fracture the reinforcements. This shear compatibility configuration is preformed in the reinforcements during their blanking and prior to bending to form their conventional U-shaped channel section with parallel lengths extending from a base that contacts an outboard fin. When fully formed, the base of the U-channel has been totally "fractured" but the legs only partially "fractured" by such piercing or slotting so that the base remains totally in tact to retain the air center immediately adjacent to the core reinforcement. Moreover, the piercing or slotting is such as to extend horizontally of the legs below the neutral axis of the reinforcement so that tne pierced or slotted leg sections are is subjected only to compression loading during typical braze fixturing. As a result, the reinforcements retain their structural rigidity during both the stacking and brazing operations. Then after brazing, the core reinforcements can be simply fully fractured by shearing the U-channel uprights or legs in the shear zone provided since the base has already been fractured. Moreover, it will be understood that slitting or piercing to form the shear zones is preferred over slotting as providing the most U-channel rigidity during braze. However, it has been found that the braze cladding on the reinforcement may flow sufficiently to "repair" such piercing and this can be avoided by simply widening the cut to the point where it is actually a blanked out slot or knockout.

DETAILED DESCRIPTION OF PREFERRED EMBODIMENTS

These and other objects, advantages and features of the present invention will become more apparent from the following description in which.

Figure 1:
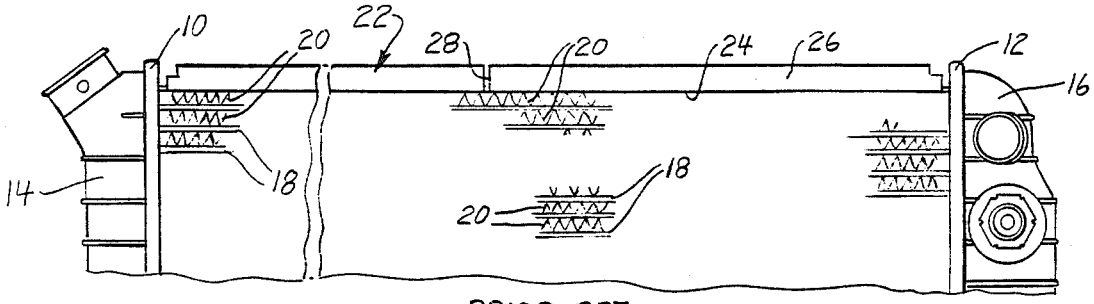
PRIOR ART FIG. 1
FIG. 1 is a partial frontal view of a motor vehicle engine radiator with conventional core reinforcements.

Referring to FIG. 1, there is shown a conventional motor vehicle engine radiator comprising a pair of headers 10 and 12 to which tanks 14 and 16 are attached respectfully, one or more rows of interleaved oval tubes 18 and corrugated fins or air centers 20 and a pair of reinforcements 22 sandwiching the tubes and fins (only one reinforcement being shown in this view). The tubes and air centers extend between the headers and are arranged so that there is an outboard located air center at both ends of the row. The reinforcements have a U-channel cross comprising a base 24 contacting the associated outboard air centers and parallel legs 26 that extend outwardly therefrom. The radiator core comprising the headers, tubes, air centers and reinforcements are stacked and temporarily banded together for brazing as further described later. Following brazing and before the radiator is placed in service, a transverse saw cut 28 is made through each of the reinforcements as shown in FIG. 1 to improve core durability by reducing the thermally induced stress in the tube-to-header joints as engine coolant temperatures swing between ambient and operative temperatures.

Figure 2:
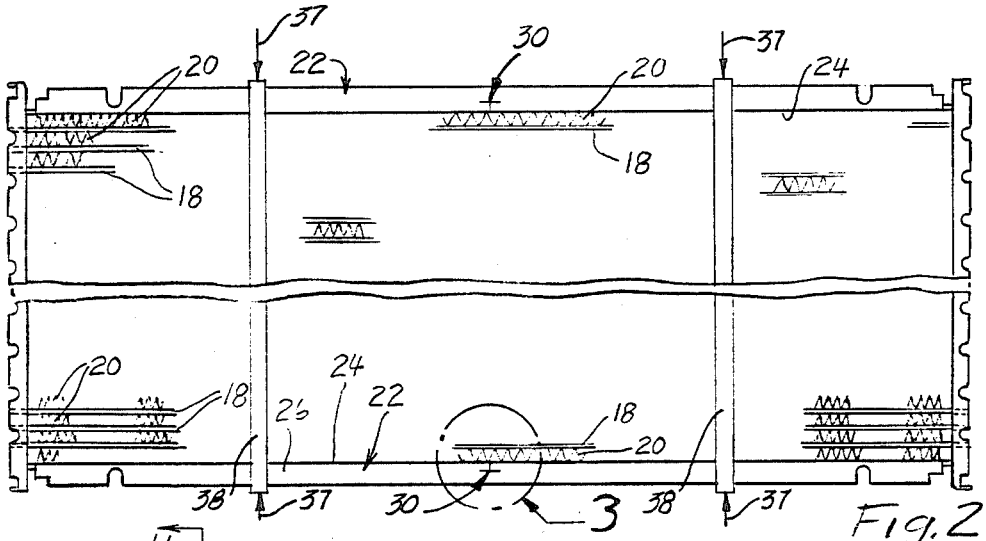
FIG. 2 is a frontal view of a motor vehicle engine radiator core like that in FIG. 1 but having core reinforcements modified according to the present invention.
Figure 3:
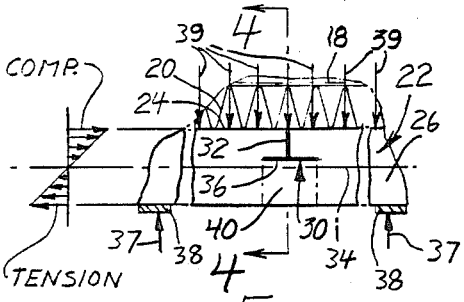
FIG. 3 is an enlarged view of the modification to the lower one of the core reinforcements in FIG. 2 according to the present invention and prior to their shearing.
Figure 4:
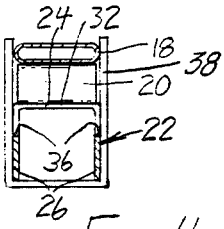
FIG. 4 is a view taken along the line 4—4 in FIG. 3.
Figure 5:
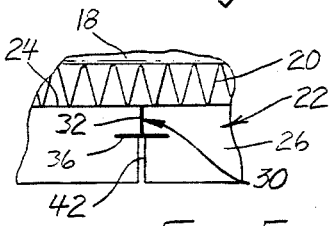
FIG. 5 is a view similar to FIG. 3 but following shearing of the core reinforcement.
Figure 6:
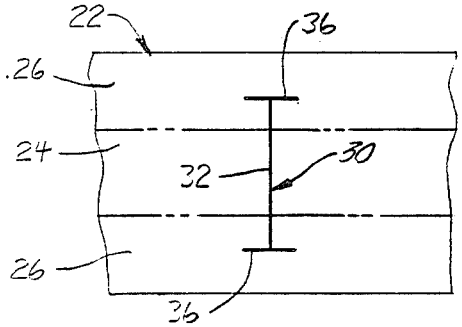
FIG. 6 is a plan view of the modified portion of the flat blank used to form the core reinforcements in FIG. 2 (i.e. prior to their formation into a channel).
Figure 7:
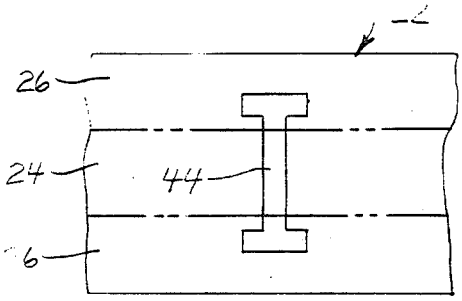
FIG. 7 is a view similar to FIG. 6 but showing slotting rather than piercing of the core reinforcements blank.

The present invention avoids the need for such saw cutting and the problems attendant therewith and is depicted in two embodiments; namely, a pierced embodiment (FIGS. 3—6) and a slotted embodiment (FIG. 7). In the pierced embodiment, the reinforcements prior to their formation from a flat blank into a channel shape are pierced such as with a blade at a mid span location as shown in FIG. 6 with an "I" shaped perforation 30 in their flat blank such that when the legs 26 are later formed to extend at right angles from the base 24, the vertical slit 32 of the "I" extends at right angles completely across the base and upward into the legs to slightly below the neutral axis 34 of the channel (see FIG. 3) and the two horizontal slits 36 of the "I" which are bisected by the vertical slit extend parallel to each other and this neutral axis. The neutral axis 34 is that horizontal axis along which no tensile or compressive stress occurs when the core reinforcement acting as a beam experiences point loads 37 applied by braze fixturing bands 38 typically applied as shown in FIG. 2 and the abutting air center produces reaction loading 39 with resulting tensile shear stress on the outboard side of the neutral axis and compressive stress on the inboard side as shown in FIG. 3. Thus, it will be appreciated that the pierced section is only subjected to compression during typical braze fixturing and therefore the reinforcements though pierced actually retain their structural rigidity during the stacking and brazing operations.

The piercing takes a "T"-shaped form in the side of the channel as seen in FIG. 3 resulting in a rectangular or square-shaped shear zone 40 in the legs as shown in phantom line extending from the respective horizontal slit 36 through the neutral axis out to the end of each leg. Following brazing, the core reinforcement can be fully fractured by simply shearing the legs in the indicated shear zone as shown by the perforation 42 in FIG. 5. Moreover, it will be appreciated that the shape, dimensions and interior angles of the piercing can be readily varied to improve process compatibility by adjusting the size of the shear zone, i.e. it can be made narrower or wider.

In the embodiment shown in FIG. 7, the "I"-shaped piercing is replaced by an "I"-shaped "knockout" or slot 44 made with a punch and die. While the slot reduces the U-channel rigidity during braze, a narrowly dimensioned slot has been found to not severely affect the air center retention and may be incorporated as the preformed shear zone producing perforation when the braze cladding on the reinforcements is found to flow sufficiently during brazing such as to "repair" a piercing produced shear zone.

Furthermore, it will be appreciated that such perforation configured shear zone can be applied to reinforcements having a "T"-shaped cross section in the one leg extending from the base thereof.

The above described preferred embodiments are illustrative of the invention which may be modified within the scope of the appended claims.

The embodiments of the invention in which an exclusive property or privilege is claimed are defined as follows:

1. A heat exchanger core comprising a pair of headers, a row of interleaved tubes and air centers extending between said headers and arranged so that there is an outboard located air center at both ends of said row, a pair of reinforcements sandwiching said row and extending along side the respective outboard air centers and between said headers, said reinforcements having a cross section with a base contacting the associated outboard air center and at least one leg extending outwardly therefrom, and perforation configured means in said reinforcements defining shear zones in their leg for maintaining rigidity in said reinforcements for fixturing and brazing of the core and being shearable thereafter to fully fracture said reinforcements.

2. A heat exchanger core comprising a pair of headers, a row of interleaved tubes and air centers extending between said headers and arranged so that there is an outboard located air center at both ends of said row, a pair of reinforcements sandwiching said row and extending along side the respective outboard air centers and between said headers, said reinforcements having a channel shaped cross section with a base contacting the associated outboard air center and legs extending outwardly therefrom, and perforation configured means in said reinforcements defining shear zones in said legs for maintaining rigidity in said reinforcements for fixturing and brazing of the core and being shearable thereafter to fully fracture said reinforcements, said reinforcements being formed from a flat blank, said perforation configured means comprising an I-shaped perforation preformed in said blanks that extends fully across said base and partially across said legs but not beyond a neutral axis extending longitudinally of said legs so as to result in a T-shaped perforation in said legs with the cross of said T extending longitudinally of said legs.

3. A heat exchanger core comprising a pair of headers, a row of interleaved tubes and air centers extending between said headers and arranged so that there is an outboard located air center at both ends of said row, a pair of reinforcements sandwiching said row and extending along side the respective outboard air centers and between said headers, said reinforcements having a channel shaped cross section with a base contacting the associated outboard air center and legs extending outwardly therefrom, and perforation configured means in said reinforcements defining shear zones in said legs for maintaining rigidity in said reinforcements for fixturing and brazing of the core and being shearable thereafter to fully fracture said reinforcements, said reinforcements being formed from a flat blank, said perforation configured means comprising an I-shaped perforation preformed in said blanks that extends fully across said base and partially across said legs but not beyond a neutral axis extending longitudinally of said legs so as to result in a T-shaped perforation in said legs with the cross of said T extending longitudinally of said legs, said I-shaped perforation being a piercing such as made with a blade.

4. A heat exchanger core comprising a pair of headers, a row of interleaved tubes and air centers extending between said headers and arranged so that there is an outboard located air center at both ends of said row, a pair of reinforcements sandwiching said row and extending along side the respective outboard air centers and between said headers, said reinforcements having a channel shaped cross section with a base contacting the associated outboard air center and legs extending outwardly therefrom, and perforation configured means in said reinforcements defining shear zones in said legs for maintaining rigidity in said reinforcements for fixturing and brazing of the core and being shearable thereafter to fully fracture said reinforcements, said reinforcements being formed from a flat blank, said perforation configured means comprising an I-shaped perforation preformed in said blanks that extends fully across said base and partially across said legs but not beyond a neutral axis extending longitudinally of said legs so as to result in a T-shaped perforation in said legs with the cross of said T extending longitudinally of said legs, said I-shaped perforation being a slot such as made with a punch and die.

* * * * *